US008360568B2

(12) United States Patent
Diederen et al.

(10) Patent No.: US 8,360,568 B2
(45) Date of Patent: Jan. 29, 2013

(54) PRINTING METHOD AND INK JET PRINTING DEVICE

(75) Inventors: Jacobus Henricus Diederen, Cuijk (NL); Theodorus Henricus Gerardus Maria Peters, Veghel (NL)

(73) Assignee: Stork Digital Imaging B.V., Boxmeer (NL)

( * ) Notice: Subject to any disclaimer, the term of this patent is extended or adjusted under 35 U.S.C. 154(b) by 968 days.

(21) Appl. No.: 12/373,928

(22) PCT Filed: Jul. 18, 2007

(86) PCT No.: PCT/NL2007/000184

§ 371 (c)(1),
(2), (4) Date: Jan. 15, 2009

(87) PCT Pub. No.: WO2008/010705

PCT Pub. Date: Jan. 24, 2008

(65) Prior Publication Data

US 2010/0013875 A1 Jan. 21, 2010

(30) Foreign Application Priority Data

Jul. 20, 2006 (NL) ..... 1032217

(51) Int. Cl.
*B41J 2/195* (2006.01)

(52) U.S. Cl. ..... 347/98; 347/14; 347/43; 347/96; 347/100

(58) Field of Classification Search ..... 347/95–100, 347/101, 7, 9, 14, 40, 43; 106/31.13, 31.27; 523/160, 161

See application file for complete search history.

(56) References Cited

U.S. PATENT DOCUMENTS

| | | | | |
|---|---|---|---|---|
| 6,322,187 | B1 * | 11/2001 | Wyble | 347/15 |
| 7,367,666 | B2 * | 5/2008 | Doi | 347/100 |
| 7,559,954 | B2 * | 7/2009 | Craamer | 8/115.51 |
| 7,651,213 | B2 * | 1/2010 | Konno et al. | 347/102 |
| 2002/0054196 | A1 | 5/2002 | Kuwahara | |
| 2003/0081094 | A1 | 5/2003 | Van Veen et al. | |
| 2004/0061760 | A1 | 4/2004 | Yano et al. | |
| 2005/0062819 | A1 | 3/2005 | Ohya et al. | |

(Continued)

FOREIGN PATENT DOCUMENTS

| | | |
|---|---|---|
| EP | 1 118 468 A2 | 7/2001 |
| EP | 1 375 163 A2 | 1/2004 |

(Continued)

*Primary Examiner* — Matthew Luu
*Assistant Examiner* — Rut Patel
(74) *Attorney, Agent, or Firm* — Hoffmann & Baron, LLP

(57) ABSTRACT

In a method for printing on a substrate, in particular a textile substrate, with the aid of an inkjet printing device, a print image to be printed is constructed by drop-by-drop deposition of one or more ink fluids in picture elements which together form the print image, an ink fluid comprising at least one predetermined concentration of at least one dye in a main solvent. The method includes for this purpose the following steps: (a) the determination of the color value of a picture element from the print image, (b) the determination of one or more dye-comprising ink fluids, in dependence on the determined color value, (c) the determination of colorless transport fluid to be applied to the picture element, in dependence on the determined color value, (d) the determination of a colorless auxiliary fluid, comprising rheology-modifying agents, in dependence on the determined color value, and (e) the application of the ink fluids, the transport fluid and the auxiliary fluid to the picture element.

8 Claims, 1 Drawing Sheet

U.S. PATENT DOCUMENTS

| | | | | |
|---|---|---|---|---|
| 2005/0276650 | A1* | 12/2005 | Van Veen et al. | 400/124.08 |
| 2006/0087540 | A1 | 4/2006 | Morimoto | |
| 2007/0013759 | A1 | 1/2007 | Kadomatsu et al. | |
| 2007/0024686 | A1* | 2/2007 | Kadomatsu et al. | 347/102 |
| 2007/0046720 | A1* | 3/2007 | Konno et al. | 347/21 |

FOREIGN PATENT DOCUMENTS

| | | | |
|---|---|---|---|
| EP | 1 391 301 | A1 | 2/2004 |
| GB | 2 356 955 | A1 | 6/2001 |
| WO | 2004 085738 | A2 | 10/2004 |

* cited by examiner

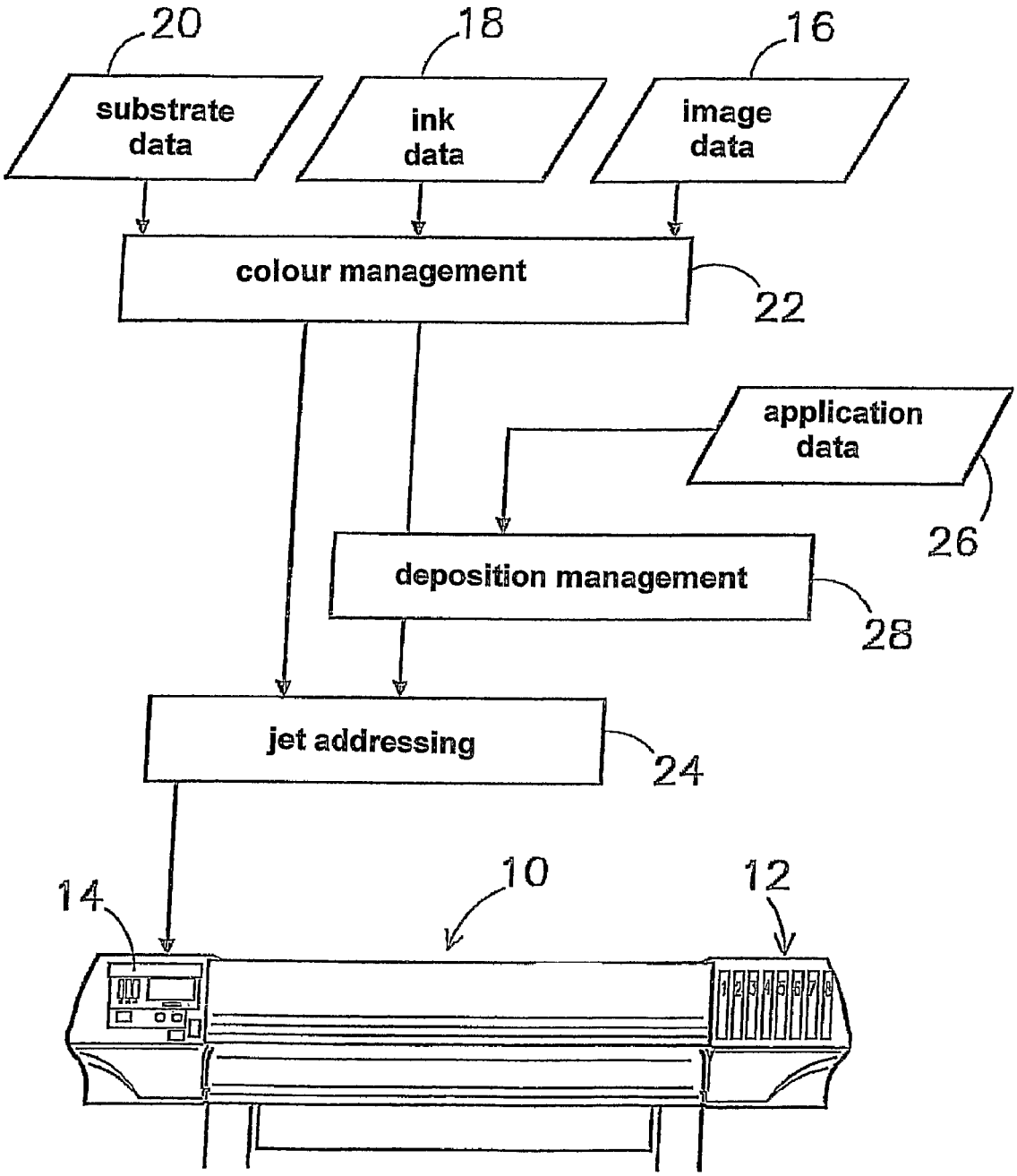
20
18
16
substrate data
ink data
image data
colour management
22
application data
26
deposition management
28
jet addressing
24
14
10
12

PRINTING METHOD AND INK JET PRINTING DEVICE

CROSS-REFERENCE TO RELATED APPLICATIONS

This application is the National Stage of International Application No. PCT/NL2007/000184, filed Jul. 18, 2007, which claims the benefit of Netherlands Application No. 1032217, filed Jul. 20, 2006, the contents of which is incorporated by reference herein.

FIELD OF THE INVENTION

The present invention relates according to a first aspect to a method for printing on a substrate, in particular a textile substrate, with the aid of an inkjet printing device, wherein a print image to be printed is constructed by drop-by-drop deposition of one or more ink fluids in a picture element, an ink fluid comprising at least one predetermined concentration of at least one dye in a main solvent.

BACKGROUND OF THE INVENTION

A method for printing on paper is known, for example, from US patent publication US 2005/0062819. In this known method, an ink fluid, which contains at least one water-soluble dye and a dispersion of resineous microparticles, is applied to a paper substrate. Additionally, a colourless ink, containing at least one resin, is used on at least a part of the substrate. The colourless ink preferably contains a resin, water-soluble solvents and water as the main constituent. Preference is for resins which are insoluble in water. The quantity of colourless ink which is applied to the paper is dependent on the quantity of dye-containing ink fluid which is applied. The quantity of colourless ink is preferably applied only to parts of the paper where no dye-containing ink fluids have been/are applied. In those areas where dye-containing ink fluids are printed, little or no colourless ink is applied. With this known method, it is intended to realize a range of objectives including, in the first place, the combating of colour deterioration resulting from the presence of harmful gases such as ozone by the sealing of the substrate surface, and, in addition, the reduction of gloss differences, the elimination of after-treatments such as heating, pressing or light irradiation, as well as the prevention of a reduction in image quality caused by ink leakage, etc.

When a substrate is printed on with the aid of an inkjet printing device, the image quality can generally be improved by applying a receiving layer to that print side of the substrate which is to be printed on. This receiving layer is composed such that the ink fluid, virtually immediately after the application, is retained in the receiving layer on the print side of the substrate. Thus, an improved colour density can be achieved, as well as an enhanced image sharpness. Accurate dosing and positioning of the ink drops of the ink fluids in order to achieve the correct sharpness and combat disturbances of the print images, for example as a result of so-called Moiré effects, are generally necessary. This applies to both textile substrates and other, for example, paper (cellulose)-based substrates.

In addition to these general requirements with regard to colour density and image sharpness, there are image quality requirements which are of greater or lesser importance, depending on the application of the printed substrate.

The evenness of colour gradients is one of these requirements. In a so-called colour wedge (saturation gradient of a colour), colour gradients, in particular differences between two neighbouring colours (also referred to as colour steps), must be as little visible as possible. In order to achieve this, according to the prior art, in addition to the basic colours K (black), C (cyan), M (magenta), and Y (yellow), the lighter variants of these colours are used, i.e. LK (light black or grey), LC (light cyan), LM (light magenta) and LY (light yellow). The colour impression is determined by the integral colour seen by the naked eye over a defined limited area. If a light colour has to be printed using ink fluids with a high density of the dyes, this implies that the drops must be deposited relatively far apart on the substrate in order to give the correct colour impression. The mutual spacing can then be of such magnitude that the drops are separately distinguishable in the form of granularity. The light variants of the basic colours are used to suppress this granularity.

The drawback of such a choice comprising an extended set of colours is that the used inkjet printing device needs to possess just as many ducts and nozzles in order to be able to make use of the full colour space covered by these basic colours and light variants thereof. When printing on a textile substrate, the use of just the basic colours K, C, M and Y often produces too limited a colour space. In order to further extend the colour space, additional colours are therefore used, such as red (R), blue (B), orange (O) and golden yellow (GY). These additional colours, in an inkjet printing device having the very same number of (typically, for example, 8) ducts and nozzles, are detrimental to the light variants of the basic colours. It may be concluded that, according to the prior art, only compromises are possible, limitations being placed upon the colour space and evenness in respect of an inkjet printing device with a given configuration.

So-called interlacing is likewise used with a view to improving the image quality. Interlacing is the construction of a picture element by the use of a plurality of different jets for each colour in order to equalize differences in jet position and drop size between different jets. By virtue of this technique, striping (i.e. visible appearance of dark or light lines parallel to the motional direction of the print head) and Moiré effects (patterns visible with the naked eye, which are caused by small differences in positioning in grids of printed drops) are suppressed. The degree of interlacing is inversely proportional to the productivity of the used printing device, which can be a drawback. After all, the print head, in order to produce a picture element with the same quantity of ink, must address the same picture element more often. The positions at which the drops exactly make contact with the substrate is primarily dependent on the accuracy of the physical zero point of each printing stroke. In addition, the positions are also dependent on the motional direction and speed of the print head in relation to the substrate. In so-called bidirectional printing, the print head prints both during the forward motion from right to left and in the return motion in the reverse direction. As a result thereof, the drop jet has in both cases an opposite lateral speed in relation to the substrate. Displacements of drop patterns in the order of magnitude of just a quarter of a picture element in relation to a previous stroke cause already with the naked eye visible differences in colour impression. The differences in positioning of the ink drops between two different strokes cause a density difference between the two printed bands as a result of the drop patterns of one stroke just overlapping or just failing to overlap with the drops of the previous stroke. Especially in surfaces with one and the same colour, bands are then visible, which is also referred to as colour banding.

In GB2356955 system is disclosed in an inkjet printer for determining the amount of a fixer to be applied to a medium.

Fixers may be a clear solution or may even be dye-based ink printed beneath a pigment-based ink. Fixers allow inks to bond to a medium thereby improving edge sharpness. Fixers also help increase the drying speed of inks and improve water fastness. Use of a transport fluid or auxiliary fluid is not disclosed.

According to US2003/0081094, thermal inkjet printheads and piezoelectric printheads may be connected to separate ink supplies to thereby enable each of the printheads to eject fluids (e.g., dyes, pigments, undercoats, over-coats, etc.) having various characteristics onto a recording medium. Examples of the various characteristics of the fluids may include, color, viscosity, pigment content, and the like. Again, use of a transport fluid or auxiliary fluid is not disclosed.

The object of EP1391301 is to provide an ink jet recording method and ink set with which recorded material with excellent gloss and greatly reduced gloss unevenness can be obtained, in which a pigment ink composition and a clear ink composition containing a resin component are discharged to record information on a recording medium, wherein the discharge amount of the pigment ink composition and/or the discharge amount of the clear ink composition is adjusted so that the gloss will be substantially uniform over the entire recording surface of the recording medium after recording.

US2002/0054196 concerns an image forming apparatus and image forming method. Use is made of a controlled amount of a diffusion liquid. Diffusion liquids are liquids which are capable of decreasing the density of ink by spreading the ink on a print material in a planar direction thereof. An example of a diffusion liquid is a liquid which thins ink, such as an organic solvent or transparent, colorless water not including dye or pigment. A diffusion liquid which has less wettability than the ink used with respect to the sheet 4, serving as a print material, that is, a diffusion liquid which does not spread on the sheet 4 more than is necessary when it is adhered thereto and which exists in liquid form for a long period of time is selected. In addition, the diffusion liquid which is selected has excellent wettability with respect to the ink used. Use of a transport liquid is not mentioned.

From US 2006/0087540 A1, a method for printing on textile with the aid of an inkjet printing device is known, wherein the ink fluid comprises a disperse dye, a dispersing agent and a water-soluble organic solvent, and the textile substrate is pre-treated with an organic acid, the pH of which is lower than the pH value of the ink fluid. With this method, it is intended to result in no waste sludge and to improve the washing characteristics of the printed substrate.

Textile printing with the aid of an inkjet printing device has per se a further number of supplementary requirements which are specifically related to the application in question.

For example, in the printing of flags, so-called through-printing needs to be achieved, so that both sides of the substrate display a comparable image. This is comparable with conventional screen printing, in which the printing paste is pressed through the cloth. In the one-sided printing with the aid of an inkjet printing device, for this a contactless transport of dye is necessary from the print side of the substrate to the opposite-situated side. If an extra quantity of ink is delivered in order to saturate the cloth and thus achieve through-printing through the substrate, a heavy and uncontrolled spreading of ink fluid may occur, which is a negative side effect. The end result can then be unsatisfactory in terms of colour value and image sharpness.

In textile printing intended for the manufacture of swimwear from high-stretch textile materials, such as a polyamide and polyurethane knitted fabric, for example polyamide Lycra, some penetration beneath the outer surface is required, without the need for full through-printing. After all, when the fabric is stretched, no uncoloured fibres must be visible. To this end, polyamide Lycra, for example, is printed with an ink fluid having within it a dispersed dye which, after the printing, under the influence of temperature and pressure diffuses in the fibres of the substrate. The flow of the dye around the fibre during the printing ultimately determines where the fibre in question is coloured. Too great a flow reduces the image sharpness of the print image. A limited flow provides a white transparency of the fibres when the printed material is stretched. It has been shown that, especially in light-coloured picture elements, flow is insufficient or totally unachievable with the techniques according to the prior art. The quantity of delivered ink is insufficient to realize the necessary depth transport or penetration.

SUMMARY OF THE INVENTION

The object of the present invention is in the first place to eliminate one or more of the abovementioned drawbacks.

More particularly, the object of the invention is to provide a method for printing on a substrate, in particular a textile substrate, with the aid of an inkjet printing device, with which method it is possible (with a defined inkjet printing device having a given number of containers with associated independently controlled ducts and nozzles, for example 8) that an essentially integrally improved end result can be achieved, in particular in terms of image quality and productivity for a wide range of different applications.

Yet another object of the invention is to provide an inkjet printing device which is suitable for the implementation of such a method.

The method for printing on a substrate, in particular a textile substrate, with the aid of an inkjet printing device according to the above-described introduction comprises, according to the invention, the following steps:

- the determination of the colour value of a picture element from the print image,
- the determination of one or more dye-comprising ink fluids to be applied to the picture element, in dependence on the determined colour value,
- the determination of colourless transport fluid to be applied to the picture element, in dependence on the determined colour value,
- the determination of a colourless auxiliary fluid, comprising rheology-modifying agents, to be applied to the picture element, in dependence on the determined colour value, and
- the application of one or more ink fluids, the transport fluid and the auxiliary fluid to the picture element.

In the method according to the invention, the colour value of a picture element (pixel) is first of all determined, and the ink fluid(s) which are necessary to achieve these colour values in a colour space such as CIE LAB (1976) with the given printing device and ink fluids. In the CIE LAB colour space, three variables are used, namely L* (luminance), a* (colour value on red-green axis) and b* (colour value on blue-yellow axis). These values are then translated into the quantities of the ink fluid(s) in question. In dependence thereon, it is determined for the picture element in question whether there is a need for extra transport fluid, or rheology modifiers, or a combination thereof, the intended end application of the printed substrate and the substrate characteristics themselves—whether or not obtained after pre-treatment of the substrate—also may be taken into account. In other words, the quality of the print image is controlled at pixel level, in particular in dependence on the desired flow behaviour. In this way, the quantity to be applied of one or more dye-comprising ink fluids in a defined pixel is no longer linked to a proportional quantity of fluid volume and/or proportional quantity of rheology-modifying agents which are present in the ink fluid, or in the ink fluid and a colourless ink as in US 2005/0062819. In place of a so-called "colour management", as has hitherto been the norm in inkjet printing devices, in the invention it is a matter of "deposition management", which calculates how much ink of which colour must be dosed in which pixel, with the addition of a separately defined and dosable quantity of transport fluid and/or separately defined and dosable rheology-modifying agents. In the method, three independently controllable streams are therefore involved, namely the ink fluid or fluids containing a dye, a transport fluid, and an auxiliary fluid comprising rheology-modifying agents.

For example, it may be desired to achieve a certain through-printing in the depth direction of a substrate such as a textile substrate, or specifically to promote a reliable flow over the surface. According to the invention, the penetration in the depth direction of the substrate can at pixel level be controlled differently from the flow in or over the surface of the substrate by determination of an appropriate quantity of transport fluid and/or auxiliary fluid for each pixel.

In principle, the different fluids (ink, transport and auxiliary fluid) can be delivered in any chosen order. The dyes or inks which are used may, however, determine a preferred order, which is determinant for the configuration of the used inkjet printing device. For example, there may be a wish for the auxiliary fluid comprising rheology-modifying agents to be applied between critical colours. If a bidirectional printing device is used, the order is different in the forward stroke from in the return stroke, unless defined ducts with associated nozzles are realized in duplicate and in symmetry.

Advantageously, in the used inkjet printing device, the ink nozzles for the transport fluid and auxiliary fluid are arranged in the middle of the row of ink nozzles for the ink fluids.

The ink fluid which is used can comprise, in addition to one or more dyes, normal other additives such as surface-active agents, rheology-modifying components and solvents. Depending on the dye types in the delivered ink volumes of the particular ink fluids in a picture element and the associated sum of, inter alia, surface-active agents, rheology-modifying constituents and solvents, within this same picture element a defined quantity of colourless transport fluid and/or a defined quantity of colourless auxiliary fluid is applied in order to control the flow behaviour of the dye(s) in question, for example the penetration in the depth direction of the substrate, or flow in or over the surface of the substrate.

In pigment printing, for example, printing is preferably carried out onto a textile substrate, which has not been pretreated specifically for inkjet printing devices. The pigment ink attaches to the spot where the ink hits the substrate. Deviations in the positioning of the ink drops usually lead to Moiré patterns and to colour banding as has been explained above, which, according to the prior art, can be prevented only by means of the repeated use of interlacing, which is detrimental to productivity. In the method according to the invention, controlled flow in primarily the surface of the substrate is realized in this application, such that the ink density scarcely diminishes, yet the dye present in the ink fluid is distributed over a larger surface area. The Moiré patterns and the colour banding are thus prevented, whilst less interlacing or no interlacing at all needs to be used. Thus, in dependence on the colour value of the picture element, and the dye which is used, a lateral transport of dye in the surface is calculated and realized by the addition of, on the one hand, transport fluid and, on the other hand, rheology-modifying agents. The ratio between them is variable, since they derive from separate sources. Usually, in the method according to the invention, in the darkest areas of the print image, no addition of transport fluid, or auxiliary fluid, will be necessary to supplement the dosed ink fluid. On the other hand, in the light portions specifically, extra transport fluid will often be necessary and, depending on the desired end result, also a supplementary quantity of rheology-modifying agents.

In flag printing, both sides of the substrate need to display a comparable image, as has already been described above. Here too it is the case that, using the method according to the invention, in dependence on the dye(s) used in the ink fluid and the colour value of a picture element, the required transport through the cloth can be calculated, and hence the desired addition of transport fluid and/or rheology-modifying agents.

As previously mentioned, the method according to the invention preferably also comprises a step of establishing the desired behaviour of the ink fluid on the substrate. More preferably, this desired flow behaviour is established at the level of each picture element.

Advantageously, the colourless transport fluid mainly comprises the main solvent of the ink fluid, so that the ink fluid and the transport fluid are compatible. The same applies to the auxiliary fluid in which the rheology-modifying agents are included in a continuous phase.

Preferably, the rheology-modifying agents are chosen from agents which promote penetration of ink fluid into the substrate and agents which promote flow over or in the surface of the substrate. Examples of the first category are, inter alia, dioctyl sodium sulfosuccinate, ethoxylates, polyether polyols, acetylene diols, octanols, and alcohols. Rheology-modifying agents which especially promote flow over the surface of the substrate comprise, for example, polyacrylates, alginates, guar gum, urea, caprolactam, lactic acid, and (alkali metal) salts thereof, in particular sodium lactic acid, sizing agent, or other chemicals comprising starch, polyvinyl pyrrolidon, polyvinyl alcohols, polyethylene glycols, glycol and glycerin.

An ink fluid which is suitable for use in an inkjet printing device generally consists of a mixture of one or more of the following constituents, viz. dyes, solvents, so-called humectants, biocides, dispersing agents, binding agents, stabilizers, anti-foam agents, and pH control agents including pH buffer agents.

The transport fluid which is used in the method according to the invention is a colourless fluid, in particular identical to the main solvent of the ink fluid. The colourless transport fluid can be distributed in a controlled manner with the aid of an inkjet printing device. In addition, the colourless fluid is readily mixable with the dye of the ink fluid and with other ink constituents. This can mean that, for each ink type, a different colourless transport fluid or rheology-modifying auxiliary fluid is necessary. This is also dependent on an optional pretreatment of the substrate.

For the flow behaviour, the following factors are generally determinant: wetting (humidification), miscibility, thickening, dilution, softening, in depth flow (fluid transport in the depth direction of the substrate), evaporation and anisotropy. The meaning hereof will be explained below.

In general, a substrate can be pre-treated with one or more of the following agents: thickening agents such as starch, guar gum and xanthane gum, levelling agents for the even distribution of the dye in the substrate, colour-fastness enhancers, which promote the attachment of the dyes to the substrate and are therefore dependent on the dye type and substrate type, complex-forming agents, optical whiteners and gloss controlling agents, in addition to stabilizers, anti-foam agents and pH control agents, including pH buffer agents.

Wetting is a central factor in ink-jet printing. This plays an important part in the print head in the start-up thereof and in the generation of drops of the correct dimensions. When the drops hit the substrate, the surface tension determines where and how the dye is distributed in and over the substrate. As known, the surface tension (which acts parallel to the surface) is related to the type of attraction between the surface molecules. This attraction is stronger, even, at the corners and margins, because fewer surrounding layers are present there. Successful wetting can be directly related to the value of the contact angle. At a contact angle >90°, no wetting takes place and the drop maintains its spherical shape. At a contact angle of less than 90°, the wetting improves and the contact surface (interface between drop and substrate) increases. At a contact angle of 0°, a full distribution is achieved. This is only possible if the surface tension of the fluid is lower than the surface tension of the substrate. A surface-active agent generally reduces the surface tension of the fluid.

Miscibility of the transport fluid and auxiliary fluid with the ink fluid is important, because otherwise a separation of the dye from the main solvent that arises on the substrate as a result of the various additions might arise. The desired evenness of the final print image might perhaps, in this way, not be achieved.

Thickening agents are used to retain the ink at the spot where the ink drop hits the substrate. If insufficient thickening agent is present, or insufficient thickening occurs, the colours start to creep, whereby the image, in particularly, loses its sharpness. Dilution can also be realized, whereby the deposited quantity of dye can be achieved over a greater width or greater depth in the substrate.

Softening of the substrate by means of the action of agents from one or more fluids may be necessary in order to influence the behaviour of the fibre at pixel level. The faster absorption of the fluid in the substrate can reduce spreading at the surface. With respect to evaporation, the aim will especially be to make one or more solvents evaporate quickly and hence to realize transport into the depth.

Anisotropy can be achieved through the use of a double pre-treatment of the substrate, namely first the soaking of the substrate with a penetration-promoting agent such as a surfactant, followed by the coating of the substrate on the print side with a top layer of a penetration-reducing agent. Following the soaking of the substrate, excess moisture will usually be removed by pressing, for example in a wringer. As a result of this pre-treatment, an ink drop has a small spread with respect to the top layer, but does penetrate therein. In other words, the ink has a substantially stronger affinity with the underlying substrate and hence flows through as far as the underside of the substrate, as is desired, for example, in flag printing. A double pre-treatment of this kind likewise forms a separate aspect of the invention.

An example of a rheology-modifying agent is, as stated, an acrylic polymer. This type of polymer possesses a high percentage of acid groups which are distributed over the polymer chains. If these acid groups are neutralized, a hydrated salt is formed. Depending on the concentration of the acid groups, the molecular weight and the degree of cross-linkage, the salt either swells in aqueous solution as a result of the used ink jets or other jets of fluids, or it becomes fully soluble in water. If the concentration of the neutralized polymer in the aqueous formulation increases, then, depending on the ink volume, the quantity and the formulation of the transport fluid and the quantity and formulation of the used auxiliary fluid with rheology-modifying agents, the swollen polymer chains start to mutually overlap until they get entangled in one another. This overlapping and entanglement brings about an increase in viscosity. Thus, the concentration of the acid groups, the molecular weight and the degree of cross-linkage of the (acrylic) polymer can influence the flow behaviour. Polysiloxanes can be used for lowering or equalizing the surface tension of the used fluid and the substrate. Typical examples comprise dimethyl siloxanes or other polysiloxanes with long chains. Where resins are used, the skeleton of the polydimethyl siloxane is often modified with alkyl or polyether side chains. In addition, reactive groups such as isocyanate, double bonds, hydroxyl groups and acid groups can be included therein, which gives the advantage that the adhesive in the printed layer can be cross-linked. These are suitable for solvent-based systems, water-based systems or combinations, in dependence on the type of side chains which are used.

An example of a humidifying agent is dialkyl sodium sulfosuccinate, this being an anionic, almost pH-neutral humidifying agent which is easily mixable with water and is already effective in low concentrations.

According to a further preferred embodiment, the method according to the invention further comprises the step of determining, for a plurality of picture elements, the ratio between the transport fluid and auxiliary fluid, and if the determined ratio is essentially constant for the plurality of picture elements, of applying the ink fluids, and a combined flow of transport fluid and auxiliary fluid, to the picture elements. It has been shown that in certain applications, including flag printing on a relatively open textile substrate, for the colour values of the picture elements which together form the print image in connection with the intended flow behaviour, there is a virtually constant ratio between the colourless transport fluid to be applied in a picture element and colourless auxiliary fluid comprising rheology-modifying agents. If this is the case, the transport fluid and auxiliary fluid can be combined in one container, containing the colourless transport fluid which comprises the rheology-modifying agents in the determined ratio. This offers the advantage that, in the printing device having a given number of containers with associated independently controlled ducts and nozzles, there is an extra unit of a container, duct and nozzle (or set of nozzles) available for a dye-comprising ink fluid, for example the lighter variants of the basic colours or additional colours in order to extend the colour space.

Advantageously, with a view to such an advantage, a method for printing on a substrate, in particular a textile substrate, with the aid of an inkjet printing device, wherein a print image to be printed is constructed by drop-by-drop deposition of one or more ink fluids in picture elements which together form the print image, an ink fluid comprising at least one predetermined concentration of at least one dye in a main solvent, comprises the following steps:

the determination of the colour values of the picture elements from the print image, the determination of one or more dye-comprising ink fluids to be applied to the picture element, in dependence on the determined colour value, the determination of colourless transport fluid to be applied to the picture element, in dependence on the determined colour value, the determination of a colourless auxiliary fluid, comprising rheology-modifying agents, to be applied to the picture element, in dependence on the determined colour value, and the determination, for the picture elements, of the ratio between the transport fluid and auxiliary fluid, and if the determined ratio is essentially constant for the picture elements, the application of the ink fluids, and a combined flow of transport fluid and auxiliary fluid, to the picture elements.

By preparing, following the establishment of the virtually constant ratio, a colourless transport fluid which also comprises rheology-modifying agents in the determined ratio, it is possible to make do with a container and a nozzle less, which, assuming a given number of nozzles, can be used for a light variant of a basic colour, an additional colour or for an identical transport fluid containing rheology-modifying agents with a view to bidirectional printing with the same order of application of the different fluids.

According to a second aspect, the invention relates to an inkjet printing device for printing on a substrate, comprising a print head having one or more ink nozzles for forming ink drops of a dye-comprising ink fluid belonging to the ink nozzle concerned, as well as having a first auxiliary nozzle for the delivery of a colourless transport fluid and having a second auxiliary nozzle for the delivery of a colourless auxiliary fluid comprising rheology-modifying agents, provided with a regulating device for regulating the desired dosage quantity of ink fluid, colourless transport fluid and colourless auxiliary fluid, comprising rheology-modifying agents, on the basis of a signal emanating from computing means for the determination of the colour value of a picture element from the print image, the determination of one or more dye-comprising ink fluids to be applied to the picture element, in dependence on the determined colour value, the determination of colourless transport fluid to be applied to the picture element, in dependence on the determined colour value, the determination of a colourless auxiliary fluid, comprising rheology-modifying agents, to be applied to the picture element, in dependence on the determined colour value. Typically, the nozzle in question is coupled with a regulated dosing device to the regulating device.

Advantageously, the auxiliary nozzles are arranged in the middle (or virtually the middle) of a row of ink nozzles for dye-comprising ink fluids.

The invention also relates to an assembly of printing ink containers for inkjet printing devices, which assembly comprises at least one container filled with an ink fluid comprising at least one predetermined concentration of at least one dye, a container filled with a colourless transport fluid and a container filled with a colourless auxiliary fluid comprising rheology-modifying agents.

Advantageously, the computing means are also set up for the inputting of data concerning the desired flow behaviour, the substrate and/or the end application, which data are taken into account in the calculations and determinations.

The invention also relates to an inkjet printing device for printing on a substrate, comprising a print head having one or more ink nozzles for forming ink drops of a dye-comprising ink fluid belonging to the ink nozzle concerned, as well as having an auxiliary nozzle, for the delivery of a colourless transport fluid comprising rheology-modifying agents, provided with a regulating device for regulating the desired dosage quantity of ink fluid and colourless transport fluid, comprising rheology-modifying agents, on the basis of a signal emanating from one or more computing means for the determination of the colour value of the picture elements from the print image, the determination of one or more dye-comprising ink fluids to be applied to the picture element, in dependence on the determined colour value, the determination of colourless transport fluid to be applied to the picture element, in dependence on the determined colour value, the determination of a colourless auxiliary fluid, comprising rheology-modifying agents, to be applied to the picture element, in dependence on the determined colour value, and the determination of the ratio between the transport fluid and auxiliary fluid.

The invention also relates to an assembly of printing ink containers for inkjet printing devices, which assembly comprises at least one container filled with an ink fluid comprising at least one predetermined concentration of at least one dye in a main solvent, a container filled with a colourless transport fluid comprising rheology-modifying agents.

The invention further relates to the application of the method according to the invention, in particular the method, using a determined constant ratio of transport fluid and rheology-modifying agents, for the one-step printing by means of double-sided penetration on a substrate, in particular a textile substrate having a relatively open structure. An example of such an application is flag printing.

The above-given details are also applicable to these aspects of the invention.

BRIEF DESCRIPTION OF THE DRAWINGS

The invention is explained in greater detail below with reference to the appended drawing, which shows in diagrammatic representation an embodiment of a control system of an inkjet printing device according to the invention.

DETAILED DESCRIPTION OF PREFERRED EMBODIMENTS

FIG. 1 shows a standard type of an inkjet printing device 10, which is suitable for printing on wide substrates. This type comprises eight (numbered 1-8) ducts 12, whereof in this case six ($\mathbf{12}^{1-3}$ and $\mathbf{12}^{6-8}$) are connected to containers for ink fluids comprising a dye in a main solvent. A duct $\mathbf{12}^{4}$ is connected to a container for transport fluid and a duct $\mathbf{12}^{5}$ is connected to a container for an auxiliary fluid comprising rheology-modifying agents. The ducts 12 are connected to ink nozzles of a print head, which is located on a carriage which can be moved to and fro in the transverse direction (denoted by a double arrow) to the motional direction of the substrate. On the left-hand side, the control device 14 is provided. The control system is explained with reference to the process diagram integrated in this FIGURE. Into the control device 14, the data 16 of the image to be printed, for example as a bit file of the pixel colour values, the data 18 of the used ink fluids and the data 20 of the substrate are inputted and stored in the memory and computing unit or colour management module 22. Based on these data 16, 18 and 20, for each picture element a calculation is made of the ink formulation which is necessary to achieve the colour value, or to come as close to it as possible. The result thereof is used in a jet addressing module 24 for addressing each nozzle. In addition, the result, together with the requirements 26 which the intended use of the substrate imposes upon the printing, is inputted into a deposition management module 28 for calculating the transport fluid and auxiliary fluid which must be added to each picture element. The result thereof is likewise used in the jet addressing module 24 to calculate for each picture element the quantities for each jet from a nozzle connected to a duct 12, i.e. the quantities of each ink fluid, transport fluid and auxiliary fluid comprising rheology-modifying agents.

If, for the substrate in question and the print image to be printed, a fixed ratio between transport fluid and rheology-modifying agents has been determined, a container for a transport fluid containing rheology-modifying agents is advantageously available, which is connected by one of the ducts 12[4] or 12[5] to the associated nozzle.

Examples of usable transport fluids, auxiliary fluids comprising rheology-modifying agents, and combined transport fluid with rheology-modifying agents are given below.

A transport fluid for use in the invention generally comprises a main solvent, usually water, a humectant, a surface-active agent, a biocide and a stabilizer. Examples of humectants, usually 10-30% by weight, comprise polyethylene glycol with molecular weights up to about 2000, such as PEG 200, isopropanol, glycerol, tripropylene glycol monomethyl ether, butyl glycol, propylene glycol, dipropylene glycol, NMP, 2,2-thiodiethanol, polyalcohols, polyether alcohols and polysaccharides. The humectant aims to adjust the viscosity of the transport fluid such that the transport fluid can be handled with the inkjet printing device in question. Suitable surface-active agents are obtainable, inter alia, under the brand name Surfynol. Other examples comprise acetylenic polyethylene oxides, derivatives of alkoxylate sulphate, fluorinated alkyloxylates, alkyl polyethylene oxides, alkyl phenyl polyethylene oxides. Examples of stabilizers are, inter alia, corrosion inhibitors, pH buffering agents and complex-forming agents.

An auxiliary fluid for use in the invention generally comprises a main solvent such as water (usually 30-95% by weight), humectant (usually 5-70%), thickening agent (up to 20%) and stabilizers. Examples of thickening agents are water-soluble cellulose ethers, carboxymethyl cellulose, hydroxypropyl methyl cellulose, polyacrylic acid, PVP and PEG with molecular weights up to about 25000.

In the case of a combined transport fluid and auxiliary fluid, the quantity of rheology-modifying agent lies generally on the low side of the range usually described for the auxiliary fluid.

TABLE 1

Transport fluid (quantities in % by weight)

| | Main solvent | Co-solvent | | Humectant | | | | | |
|---|---|---|---|---|---|---|---|---|---|
| | | | | PEG | | Propylene | Surface-active | | |
| Example | Water | Type | | LMW | Glycerol | glycol | substance | Biocide | Stabilizer |
| 1 | 79.4 | | | 20 | | | 0.5 (Surfynol) | 0.1 | |
| 2 | 59.4 | | | 40 | | | 0.5 | 0.1 | |
| 3 | 79.4 | | | | 20 | | 0.5 | 0.1 | |
| 4 | 79.4 | | | | | 20 | 0.5 | 0.1 | |
| 5 | 79.4 | | | 10 | 10 | | 0.5 | 0.1 | |
| 6 | 69.4 | Tripropylene glycol monoether | 10 | 10 | | | 0.5 | 0.1 | |
| 7 | 69.4 | Isopropyl alcohol | 10 | 10 | | | 0.5 | 0.1 | |
| 8 | 69.4 | 2-(2-butoxyethoxy) ethanol | 10 | 20 | | | 0.5 | 0.1 | |
| 9 | 74.4 | triethanolamine | 5 | 20 | | | 0.5 | 0.1 | |
| 10 | 78.4 | | | 20 | | | 0.5 | 0.1 | 1 |
| 11 | 79.8 | | | 20 | | | 0.1 (Byk) | 0.1 | |
| 12 | 79.8 | | | 20 | | | 0.1 (Triton) | 0.1 | |
| 13 | 79.8 | | | 20 | | | 0.1 {Surfynol) | 0.1 | |
| 14 | 79.7 | | | 20 | | | 0.2 (Tergitol) | 0.1 | i |
| 15 | 79.4 | | | 20 | | | 0.5 (Tegowet) | 0.1 | |
| | 79.4 | | | 20 | | | 0.2 (Triton) | 0.1 | |
| 17 | 79.6 | | | 20 | | | 0.2 (Surfynol) 0.1 (Byk) | 0.1 | |

LMW = Low Molecular Weight

TABLE 2

Auxiliary fluid (quantities in % by weight)

| | Main | Humectant | Rheology modifier | | | Surface-active | |
|---|---|---|---|---|---|---|---|
| Example | solvent Water | PEG LMW | Polyvinyl alcohol | Polyvinyl pyrrolidon | PEG HMW | substance Surfynol | Biocide |
| 1 | 74.4 | 25 | 5 (LMW) | | | 0.5 | 0.1 |
| 2 | 77.4, 4 | 25 | 2 (MMW) | | | 0.5 | 0.1 |
| 3 | 78.4 | 25 | 1 (HMW) | | | 0.5 | 0.1 |
| 4 | 69.4 | 15 | 10 (LMW) | | | 0.5 | 0.1 |
| 5 | 68.4 | 30 | 1 (LMW) | | | 0.5 | 0.1 |
| 6 | 74.4 | 20 | | 5 (LMW) | | 0.5 | 0.1 |
| 7 | 76.9 | 20 | | 2.5 (MMW) | | 0.5 | 0.1 |
| 8 | 78.4 | 20 | | 1 (HMW) | | 0.5 | 0.1 |
| 9 | 74.4 | 15 | | 10 (LMW) | | 0.5 | 0.1 |
| 10 | 68.4 | 30 | | 1 (LMW) | | 0.5 | 0.1 |
| 11 | 74.4 | 20 | | | 5 | 0.5 | 0.1 |
| 12 | 78.4 | 20 | | | 1 | 0.5 | 0.1 |
| 13 | 78.4 | 20 | | | 10 | 0.5 | 0.1 |
| 14 | 74.4 | 15 | | | 10 | 0.5 | 0.1 |
| 15 | 68.4 | 30 | | | 1 | 0.5 | 0.1 |

LMW = Low Molecular Weight; MMW = Intermediate Molecular Weight; HMW = High Molecular Weight; LMW < MMW < HMW

TABLE 3

| Combination fluid (quantities in % by weight) | | | | | | | | |
|---|---|---|---|---|---|---|---|---|
| | Main | Humectant | Rheology modifier | | | | Surface-active | |
| Example | solvent Water | PEG LMW | Polyvinyl alcohol | Polyvinyl pyrrolidon ( | PEG HMW | glycerol | substance Surfynol | Biocide |
| 1 | 68.4 | 30 | 1 (LMW) | | | | 0.5 | 0.1 |
| 2 | 65.4 | 33.9 | 0.1 (LMW) | | | | 0.5 | 0.1 |
| 3 | 59.4 | 30 | | | | 10 | 0.5 | 0.1 |
| 4 | 68.4 | 30 | | 1 (LMW) | | | 0.5 | 0.1 |
| 5 | 65.4 | 33.9 | | 0.1 (LMW) | | | 0.5 | 0.1 |
| 6 | 68.4 | 30 | | | 1 | | 0.5 | 0.1 |
| 7 | 65.4 | 33.9 | | | 0.1 | | 0.5 | 0.1 |

The invention claimed is:

1. A method for printing on a substrate, in particular a textile substrate, with the aid of an inkjet printing device, wherein a print image to be printed is constructed by drop-by-drop deposition of one or more ink fluids in picture elements which together form the print image, an ink fluid comprising at least one predetermined concentration of at least one dye in a main solvent, which method comprises the following steps:

determining colour value of a picture element from the print image, determining one or more dye-comprising ink fluids to be applied to the picture element, in dependence on the determined colour value, determining colourless transport fluid to be applied to the picture element, in dependence on the determined colour value, wherein the colourless transport fluid comprises the main solvent of the ink fluid, determining a colourless auxiliary fluid, comprising rheology-modifying agents, to be applied to the picture element, in dependence on the determined colour value, wherein the auxiliary fluid comprises the main solvent of the ink fluid, in which the rheology-modifying agents are incorporated, and applying one or more ink fluids, the transport fluid and the auxiliary fluid to the picture element.

2. The method according to claim 1, wherein the ink fluid exhibits flow behaviour and additionally comprising a step that involves establishing the desired flow behaviour of the ink fluid on the substrate.

3. The method according to claim 2, wherein the desired flow behaviour of the ink fluid is established at picture element level.

4. The method according to claim 1, wherein the colourless transport fluid mainly comprises the main solvent of the ink fluid.

5. The method according to claim 1, wherein the rheology-modifying agents are chosen from agents which promote penetration of ink fluid into the substrate and agents which promote flow over the surface of the substrate.

6. The method according to claim 1, wherein the substrate is pre-treated.

7. The method according to claim 6, wherein the substrate has been pre-treated by soaking the substrate with a penetration-promoting agent, followed by coating the substrate on the print-receiving print side with a top layer of a penetration-reducing agent.

8. The method according to claim 1, further comprising:

the step of determining, for a plurality of picture elements, the ratio between the transport fluid and auxiliary fluid; and if the determined ratio is essentially constant for the plurality of picture elements, the step of applying the ink fluids, and a combined flow of transport fluid and auxiliary fluid, to the picture elements.

* * * * *